US006547590B2

(12) United States Patent
Zhu et al.

(10) Patent No.: US 6,547,590 B2
(45) Date of Patent: Apr. 15, 2003

(54) ELECTRICAL CONNECTOR ASSEMBLY HAVING SPACER FOR POSITIONING TERMINALS

(75) Inventors: ZiQiang Zhu, Kunsan (CN); Guohua Zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,617

(22) Filed: Dec. 26, 2001

(65) Prior Publication Data

US 2002/0081896 A1 Jun. 27, 2002

(30) Foreign Application Priority Data

Dec. 27, 2000 (TW) ..... 89222557 U

(51) Int. Cl.[7] ..... H01R 13/66

(52) U.S. Cl. ..... 439/540.1; 439/541.5

(58) Field of Search ..... 439/540.1, 541.5, 439/63, 79

(56) References Cited

U.S. PATENT DOCUMENTS 6,200,161 B1 * 3/2001 McClinton et al. ..... 439/541.5
6,227,904 B1 * 5/2001 Wang et al. ..... 439/541.5
6,234,834 B1 * 5/2001 Tsai et al. ..... 439/541.5

* cited by examiner

*Primary Examiner*—P. Austin Bradley
*Assistant Examiner*—Alexander Gilman
(74) *Attorney, Agent, or Firm*—Wei Te Chung

(57) ABSTRACT

An electrical connector assembly (1) comprises a first spacer (10), a second spacer (20) retained within the first spacer and a first and a second connectors (30, 40) secured to first and second depressed surfaces **(10*c*, 10*d*) of the first spacer, respectively. The second spacer defines a plurality of terminal receiving slots (22) therein. The second connector comprises a plurality of terminals (44) having solder tails (44*b*)** retained to the terminal receiving slots of the second spacer.

7 Claims, 4 Drawing Sheets

ELECTRICAL CONNECTOR ASSEMBLY HAVING SPACER FOR POSITIONING TERMINALS

BACKGROUND OF THE INVENTION

1. Field of the Invention

The present invention relates to an electrical connector assembly having a spacer for poisoning longer solder tails of terminals.

2. Description of Related Art

An electrical connector assembly related to the present invention comprises a first connector at an upper position and a second connector at a lower position. The first and second connectors comprise a plurality of first and second terminals having first and second solder tails. The first and second solder tails extend from rear faces of first and second housings of the connectors and toward to a motherboard on which the connectors are mounted. Generally, an insulating space is provided to position the first solder tails which are much longer than the first solder tails, thereby preventing the first solder tails from being curved by touching of an external force. However, a shortcoming of such a design is that the spacer must be secured to the connector assembly and the stability of the engagement between the spacer and the connector assembly is difficult to be ensured.

SUMMARY OF THE INVENTION

Accordingly, the object of the present invention is to provide an electrical connector assembly having a spacer capable of stably securing solder tails of terminals of the connector assembly.

In order to achieve the object set forth, an electrical connector assembly comprises a first spacer, a second spacer retained within the first spacer and a first and a second connectors secured to the first spacer, respectively. The first spacer defines a first depressed surface lower than a top surface thereof and a second depressed surface lower than the top surface but higher than the first depressed surface. The first spacer defines a plurality of first terminal receiving slots at the first depressed surface thereof, and a spacer receiving slot at the second depressed surface thereof. The second spacer is retained within the spacer receiving slot and defining a plurality of second terminal receiving slots therein. The first connector is secured to the first depressed surface of the first spacer and comprises a plurality of first terminals having solder tails retained to the first terminal receiving slots of the first spacer. The second connector comprises a plurality of second terminals having solder tails retained to the second terminal receiving slots of the second spacer.

Other objects, advantages and novel features of the invention will become more apparent from the following detailed description of the preferred embodiment when taken in conjunction with the accompanying drawings.

DETAILED DESCRIPTION OF THE INVENTION

Figure 1:
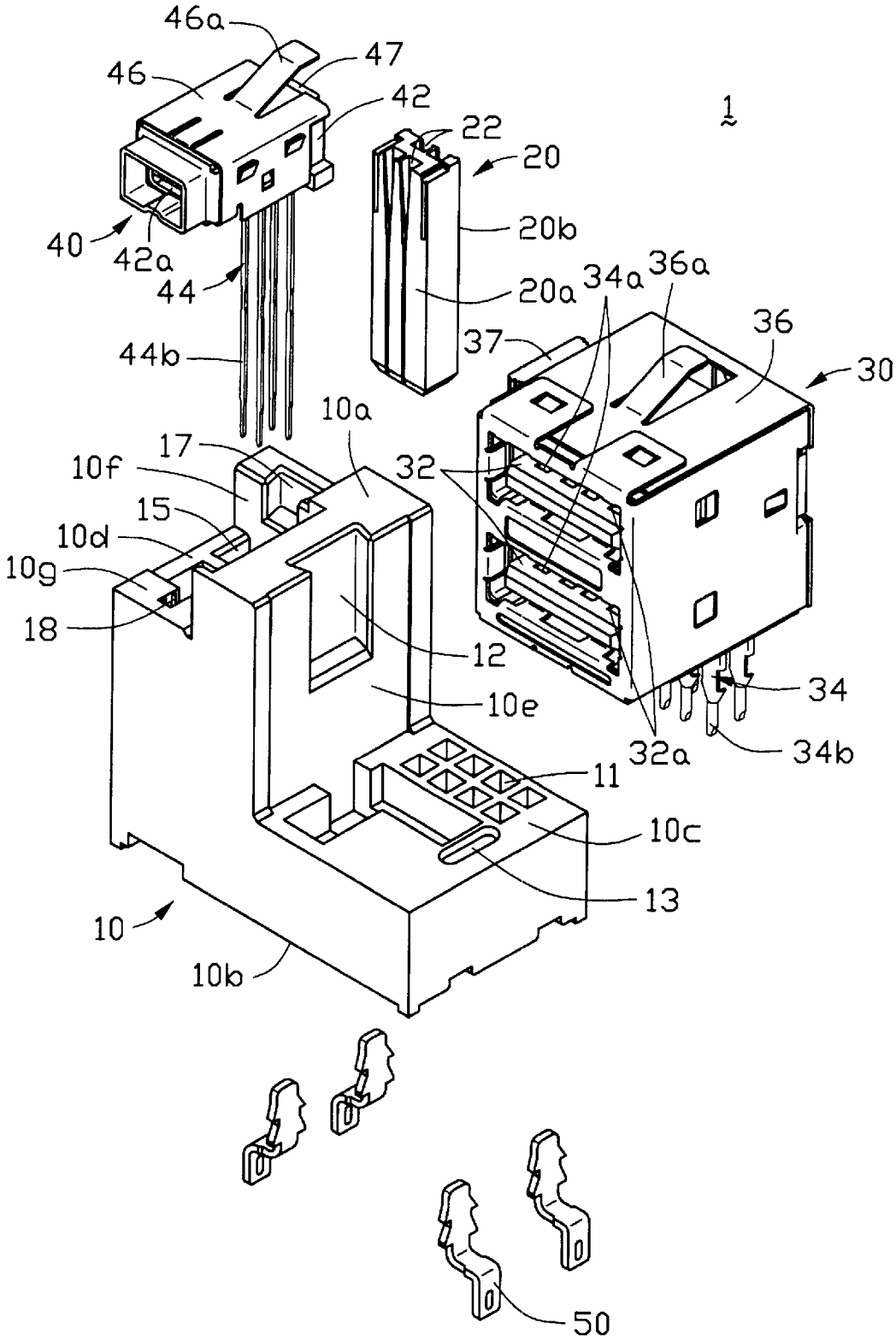
FIG. 1 is an exploded view of an electrical connector assembly of the present invention.

Reference will now be made to the drawing figures to describe the present invention in detail.

Figure 2:
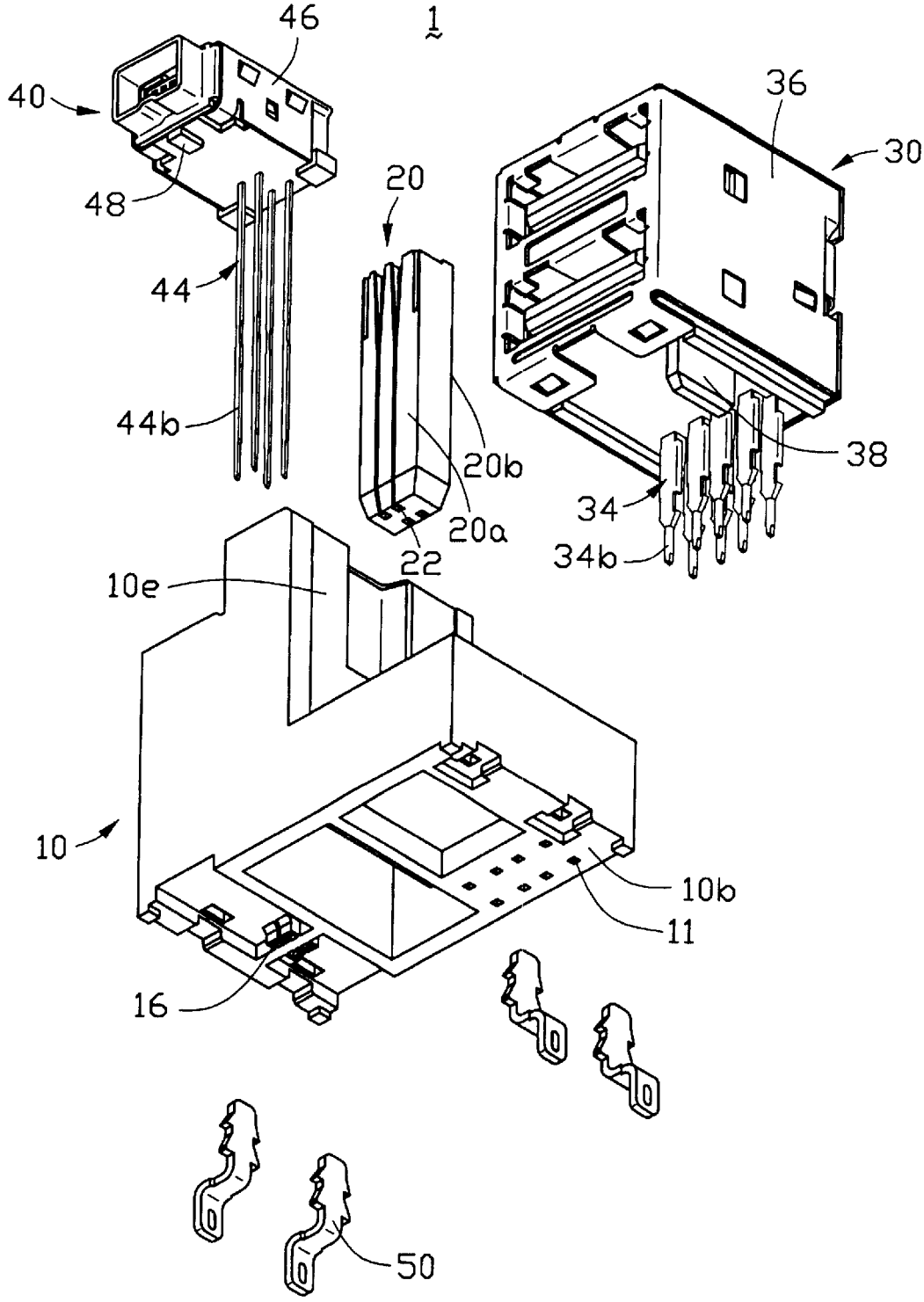
FIG. 2 is an exploded view of the electrical connector assembly of FIG. 1 from another viewpoint.
Figure 3:
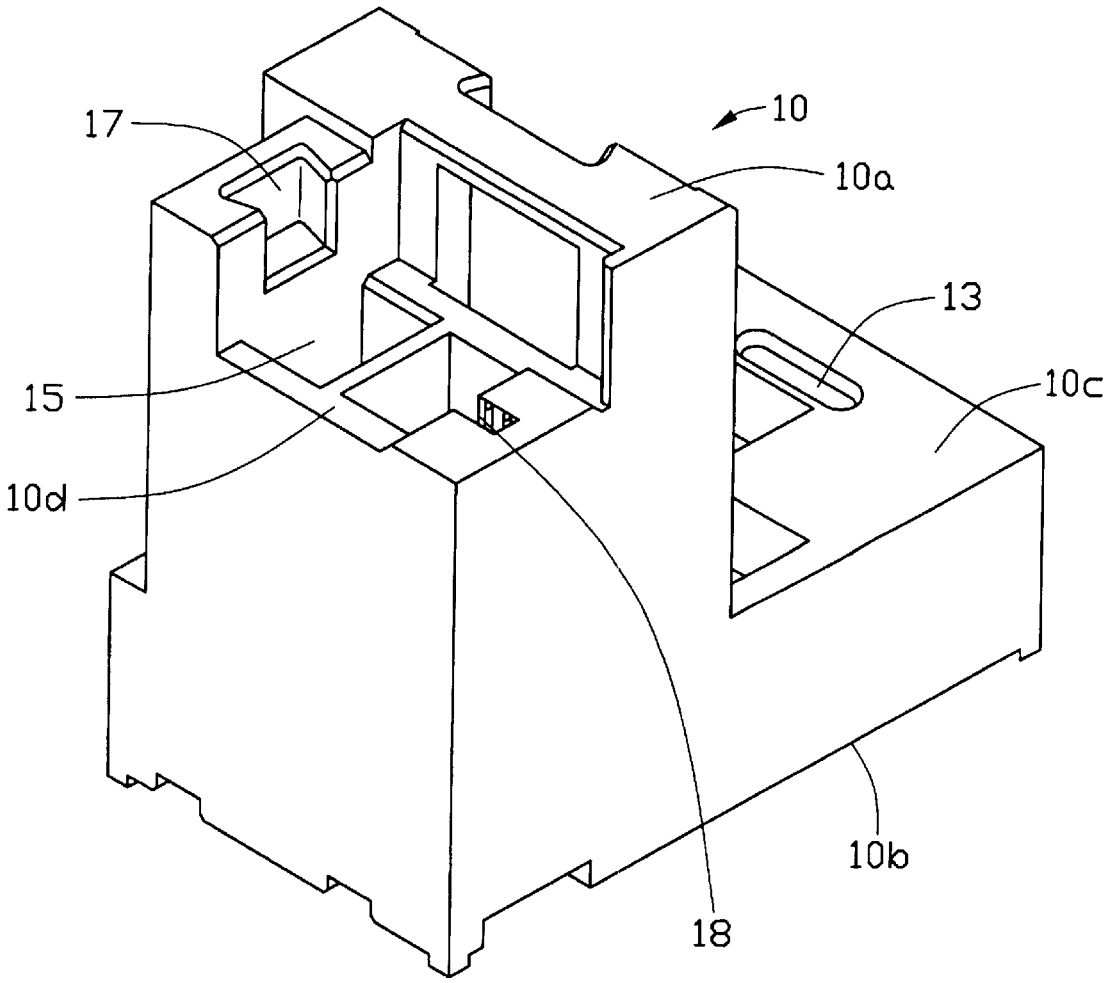
FIG. 3 is a respective view of a first spacer of the electrical connector assembly of FIG. 1.

Referring to FIGS. 1 to 3, an electrical connector assembly 1 of the present invention comprises a first spacer or bracket 10, a second spacer 20, a first connector 30 and a second connector 40 secured to the first spacer 10, and four locks 50 to lock the first spacer 10 to a motherboard.

The first spacer 10 defines a first depressed surface 10*c* lower than a top surface 10*a* thereof, and a second depressed surface 10*d* lower than the top surface 10*a* and lower than the first depressed surface 10*c*. The top surface 10*a*, the bottom surface 10*b*, the first and the second depressed surfaces 10*c* and 10*d* are paralleled to each other. The first spacer 10 defines a plurality of first terminal receiving slots 11 at the first depressed surface 10*c*, a first retaining slot 12 at a first vertical surface 10*e*, and a second retaining slot at the first depressed surface 10*c*. The first spacer 10 defines a spacer receiving slot 15 at the second depressed surface 10*d* thereof and in communicating with the bottom surface 10*b*, a third retaining slot 17 at a second vertical surface 10*f*, and a fourth retaining slot 18 at a third depressed surface 10*g*.

The second spacer 20 defines two rows of second terminal receiving slots 22 in communicating with top and bottom surfaces thereof. The second terminal receiving slots 22 at a side surface 20*a* is staggered with those at the other side surface 20*b* thereof. Each second terminal receiving slot 22 defines a V-shaped opening at upper ends thereof.

The first connector 40 includes a first insulating housing 32 having two mating ends 32*a* at a front thereof, a plurality of first terminals 34, and a tow-piece shield 36 shielding the housing 32. The first terminals 34 include mating portions 34*a* secured to the mating ends 32*a* of the housing 32, and solder tails 34*b* downwardly extending therefrom to be soldered to the motherboard. The shield 36 forms a first resilient grounding plate 36*a* at a top thereof. The first housing 32 includes a retaining portion 37 at a side thereof and a second retaining portion 38 at a bottom thereof.

The second connector 40 includes a second insulating housing 42 defining a mating end 42*a* at a front thereof, a plurality of second terminals 44, and a two-piece shield 46 shielding the housing 42. The second terminals 44 include mating portions (not shown) secured to the mating end 42*a* and solder tails 44*b* downwardly extending therefrom to be soldered to the motherboard. The shield 46 includes a second resilient grounding plate 46*a* at a top thereof. The second housing 42 further includes a third retaining portion 47 at a rear thereof, and a fourth retaining portion 48 at a bottom thereof.

Figure 4:
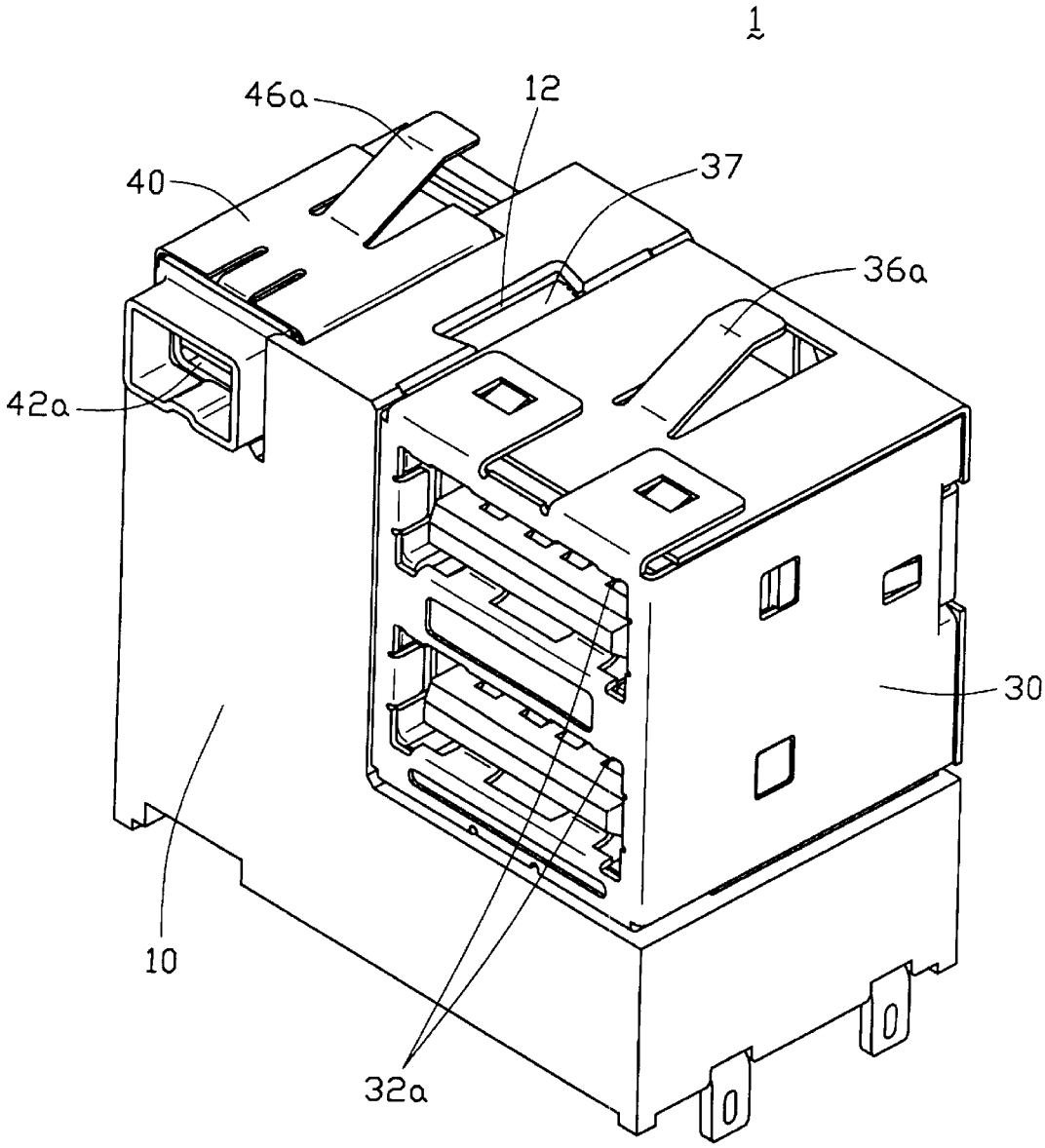
FIG. 4 is an assembled view of the electrical connector assembly of FIG. 1.

Also referring to FIG. 4, in assembly, the first connector 30 is first assembled to the first depressed surface 10*c* of the first spacer 10 by retaining the first and second retaining portions 37 and 38 within the first and second retaining slots 12 and 13. The solder tails 44*b* of the second terminals 44 are retained to the second terminal receiving slots of the second spacer 20. The second connector 40 an the second spacer 20 are together secured to the second depressed surface 10*d* of the first spacer 10 by retaining the third and fourth retaining portions 47 and 48 within the third and fourth retaining slots 17 and 18. The second spacer 20 is securely retained within the spacer receiving slot 15 of the first spacer 10.

It is noted that longer solder tails 44*b* of the second terminals 44 are retained in the second spacer 20 which is retained in the first spacer 10, and the first and second connectors 30 and 40 are also secured to the first spacer 10. Thus, the first and second connectors 30 and 40 are securely assembled together and the solder tails 44*b* of the second terminals 44 are also securely located.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first spacer defining a plurality of first terminal receiving slots and a spacer receiving slot in communicating with a bottom thereof;

a second spacer received within the spacer receiving slot of the first spacer and defining a plurality of second terminal receiving slots therein;

a first connector secured to the first spacer and including a first housing and a plurality of first terminals secured to the first housing, the first terminals including first solder tails extending through the first terminal receiving slots of the first spacer; and a second connector secured to the first spacer and including a second housing disposed beside the first housing and a plurality of second terminals, the second terminals including second solder tails extending through the second terminal receiving slots of the second spacer for being soldered to a motherboard, wherein the second terminal receiving slots are defined at two opposite sides of the second spacer, the terminal receiving slots are defined at two opposite sides of the second spacer, the terminal receiving slots at one side being staggered with those at the other side, wherein the first spacer defines a first depressed surface thereof, and a second depressed surface lower than the top surface but higher than the first depressed surface, the first connector is arranged on the first depressed surface and the second connector is arranged on the second depressed surface.

2. The electrical connector assembly as claimed in claim 1 wherein each second terminal receiving slot defines a V-shaped opening at an upper end thereof.

3. The electrical connector assembly as claimed in claim 1, wherein the first and the second depressed surfaces are both parallel to the top surface of the first spacer.

4. The electrical connector assembly as claimed in claim 1, wherein the first housing defines a first retaining portion at a side thereof, and the first spacer defines a first retaining slot engaging the first retaining portion.

5. The electrical connector assembly as claimed in claim 4, wherein the first housing defines a second retaining portion at a bottom thereof, and the first spacer defines a second retaining slot at the first depressed surface to retain the second retaining portion therein.

6. The electrical connector assembly as claimed in claim 5, wherein the second housing defines a third retaining portion at a rear thereof, and the first spacer defines a third slot engaging the third retaining portion.

7. The electrical connector assembly as claimed in claim 6 wherein the second housing defines a fourth retaining portion at a bottom thereof, and the first spacer defines a fourth retaining slot engaging the fourth retaining portion.

* * * * *